US008690204B2

(12) United States Patent
Lang et al.

(10) Patent No.: US 8,690,204 B2
(45) Date of Patent: Apr. 8, 2014

(54) FLUSH DOOR HANDLE ASSEMBLY WITH NORMAL DEPLOYMENT

(75) Inventors: Steven C. Lang, Columbus, MI (US); Hesham A. Ezzat, Troy, MI (US); Joseph M. Polewarczyk, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 107 days.

(21) Appl. No.: 13/303,666

(22) Filed: Nov. 23, 2011

(65) Prior Publication Data

US 2013/0127185 A1 May 23, 2013

(51) Int. Cl.
*E05B 3/00* (2006.01)
*E05C 19/00* (2006.01)

(52) U.S. Cl.
USPC .. 292/336.3; 292/279; 292/280; 292/DIG. 31

(58) Field of Classification Search
USPC ..... 292/1, 241, 279, 280, 336.3, DIG. 30, 292/DIG. 31; 296/50; 16/110.1
See application file for complete search history.

(56) References Cited

U.S. PATENT DOCUMENTS 552,950 A * 1/1896 Abbott ..... 292/1
2,017,244 A * 10/1935 Gudmundsen ..... 16/200
3,508,362 A * 4/1970 Wright ..... 49/340
4,476,700 A * 10/1984 King ..... 70/99
4,943,104 A * 7/1990 Zani et al. ..... 296/223
5,123,687 A * 6/1992 Pfeiffer et al. ..... 292/336.3
5,205,074 A * 4/1993 Guhl et al. ..... 49/386
7,185,927 B2 * 3/2007 Talukdar et al. ..... 292/172
7,621,573 B2 11/2009 Thomas et al.
7,832,239 B2 * 11/2010 Kozuka et al. ..... 70/162
7,905,530 B2 * 3/2011 Browne et al. ..... 296/1.02
8,282,142 B2 * 10/2012 Fannon ..... 292/336.3
2004/0256860 A1 * 12/2004 Tsai ..... 292/51
2005/0057047 A1 * 3/2005 Kachouh et al. ..... 292/201
2005/0104380 A1 * 5/2005 Cho ..... 292/33
2008/0163555 A1 * 7/2008 Thomas et al. ..... 49/460
2008/0197651 A1 * 8/2008 Stratten ..... 296/50
2010/0127516 A1 * 5/2010 Fannon ..... 292/336.3
2010/0127616 A1 * 5/2010 Kai et al. ..... 313/504

FOREIGN PATENT DOCUMENTS

DE 3427178 A1 * 2/1986
EP 1099810 A1 * 5/2001

* cited by examiner

*Primary Examiner* — Kristina R Fulton
*Assistant Examiner* — Faria Ahmad
(74) *Attorney, Agent, or Firm* — Quinn Law Group, PLLC

(57) ABSTRACT

A closure assembly includes a handle assembly having a grab bar. The grab bar is moveable in a normal direction relative to an exterior panel surface of the closure assembly between a retracted position and an extended position. When in the retracted position, an outboard surface of the grab bar is disposed approximately flush with the exterior panel surface. The closure assembly includes a position sensor configured for sensing the presence of an operator, and signals the handle assembly to move the grab bar into the extended position when the presence of the operator is sensed. When the grab bar is grasped, the handle assembly signals a latch mechanism to move into an un-latched position to allow the closure assembly to open.

13 Claims, 2 Drawing Sheets

FLUSH DOOR HANDLE ASSEMBLY WITH NORMAL DEPLOYMENT

TECHNICAL FIELD

The invention generally relates to a handle assembly for a closure assembly of a vehicle, and a method of controlling the handle assembly.

BACKGROUND

Vehicle doors include an exterior handle assembly that is mechanically or electrically coupled to a latch mechanism. Actuation of the handle assembly moves the latch mechanism from a latched position to an un-latched position to allow the door to open. The handle assembly may be designed to extend outboard of an exterior panel surface of the door to allow an operator to grasp the handle assembly. Alternatively, the exterior panel surface of the door may define an inward recess to allow the operator to grasp the handle assembly. Furthermore, vehicle styling may require that an outboard surface of the handle assembly be positioned approximately flush with the exterior panel surface of the door when not in use. When needed to open the door, the flush mounted handle assembly deploys out through a swing or pivot motion relative to the exterior panel surface of the door, thereby allowing the operator to grasp the handle assembly.

SUMMARY

A closure assembly is provided. The closure assembly includes a structure. The structure includes an exterior panel surface that defines an opening extending therethrough. A handle assembly is coupled to the structure. The handle assembly includes a grab bar having an outboard surface. The grab bar is moveable between a retracted position and an extended position. The grab bar moves relative to the exterior panel surface of the structure. The grab bar is positioned within the opening when in the retracted position with the outboard surface of the grab bar approximately flush with the exterior panel surface of the structure. The grab bar is laterally spaced outboard of the exterior panel surface of the structure when the grab bar is in the extended position.

A method of controlling a handle assembly of a closure assembly is also provided. The method includes signaling the handle assembly to position a grab bar of the handle assembly in an extended position. When the grab bar is positioned in the retracted position and the handle assembly is signaled to position the grab bar in the extended position, the grab bar is moved in a normal direction relative to an exterior panel surface of the closure assembly from the retracted position into the extended position to allow the operator to grasp the grab bar to open the vehicle door. The method further includes signaling the handle assembly to position the grab bar of the handle assembly in the retracted position. When the grab bar is positioned in the extended position and the handle assembly is signaled to position the grab bar in the retracted position, the grab bar is moved in a normal direction relative to the exterior panel surface of the closure assembly from the extended position into the retracted position so that an outboard surface of the grab bar is disposed approximately flush with the exterior surface panel when the grab bar is not needed to open the vehicle door.

Accordingly, the grab bar of the handle assembly moves in a normal direction relative to the exterior panel surface of the door, between the retracted position in which the outboard surface of the grab bar is approximately flush with the exterior panel surface, and the extended position in which the grab bar is spaced from the exterior panel surface to allow the operator to grasp the grab bar. The position of the grab bar when in the retracted position, approximately flush with the exterior panel surface of the door, in combination with the movement of the grab bar in the normal direction relative to the exterior panel surface, provides a new and pleasing style feature to the closure assembly.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "outboard," "inboard," etc., are used descriptively for the figures, and do not represent limitations on the scope of the invention, as defined by the appended claims.

Referring to the Figures, wherein like numerals indicate like parts throughout the several views, a closure assembly is generally shown at 20. The closure assembly 20 may be configured for use as a side door of a vehicle, a rear cargo door of a vehicle, or some other vehicular closure. Furthermore, it should be appreciated that the closure assembly may be configured for some other use not associated with a vehicle, such as but not limited to a cabinet door.

Figure 3:
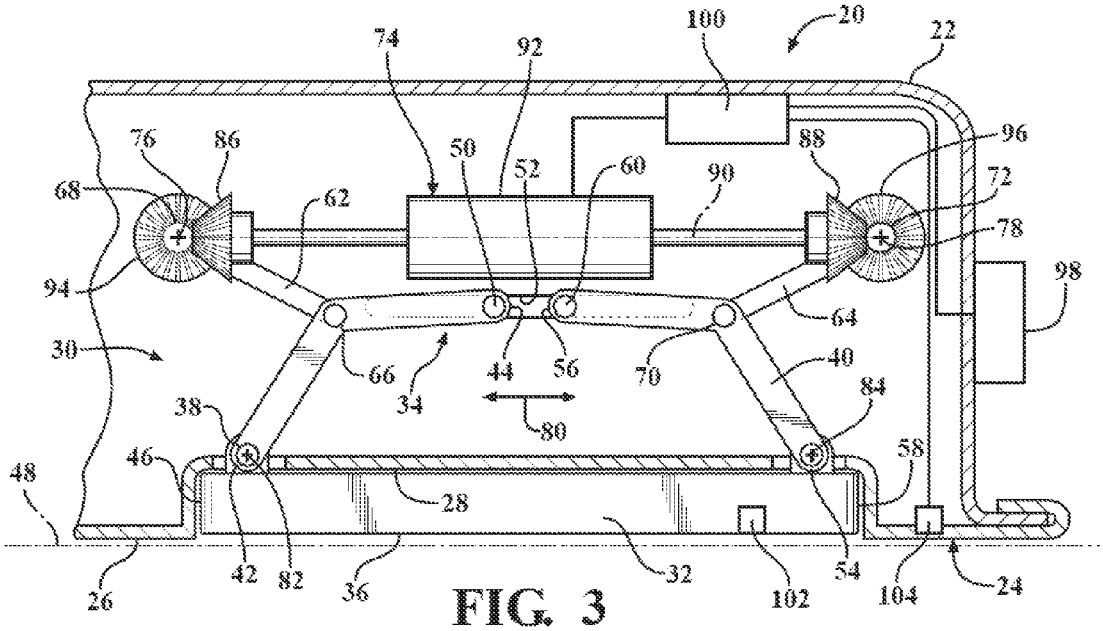
FIG. 3 is a schematic plan view of the closure assembly showing the grab bar in the retracted position.
Figure 4:
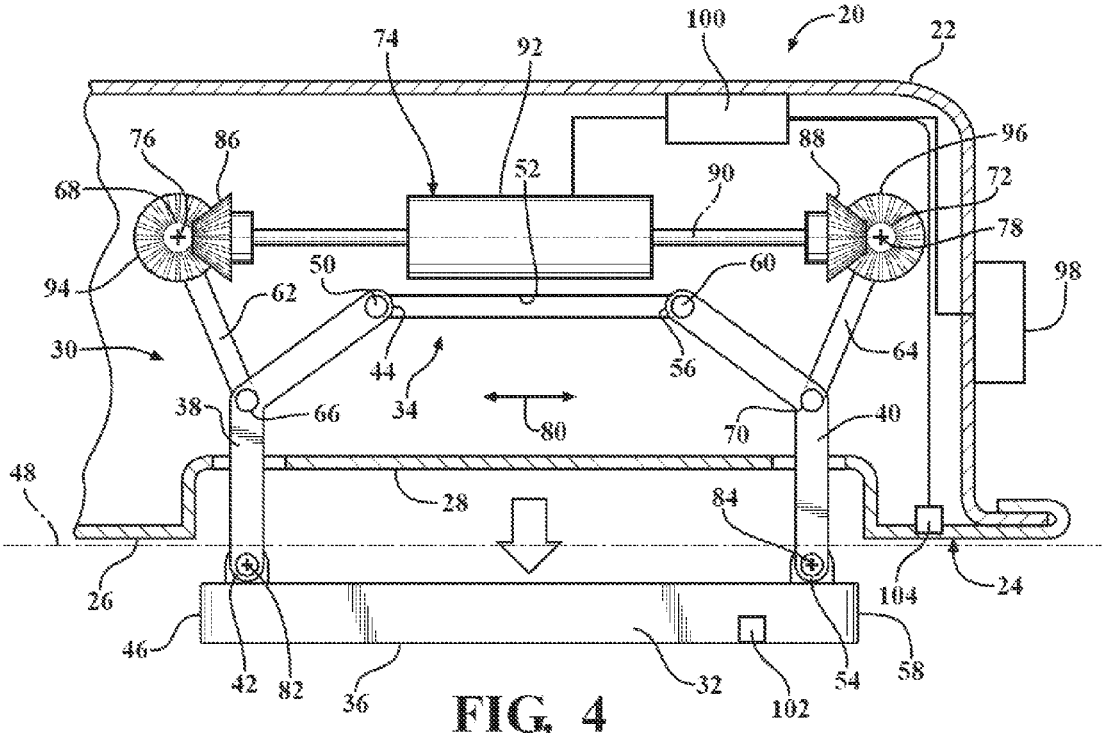
FIG. 4 is a schematic plan view of the closure assembly showing the grab bar in the extended position.

Referring to FIGS. 3 and 4, the closure assembly 20 includes a structure 22. The structure 22 includes a panel 24 defining an exterior panel surface 26, and all braces, supports, etc. necessary to support the panel 24 and the various components of the closure assembly 20, and to attach the closure assembly 20 to the vehicle. The exterior panel surface 26 is disposed on an outboard side of the panel 24. As used herein, the term "outboard" refers to a location relative to a center of the vehicle that is located further away from an "inboard" location. As such, an inboard location is disposed nearer the center of the vehicle relative to an outboard location, which is disposed farther from the center of the vehicle.

Figure 1:
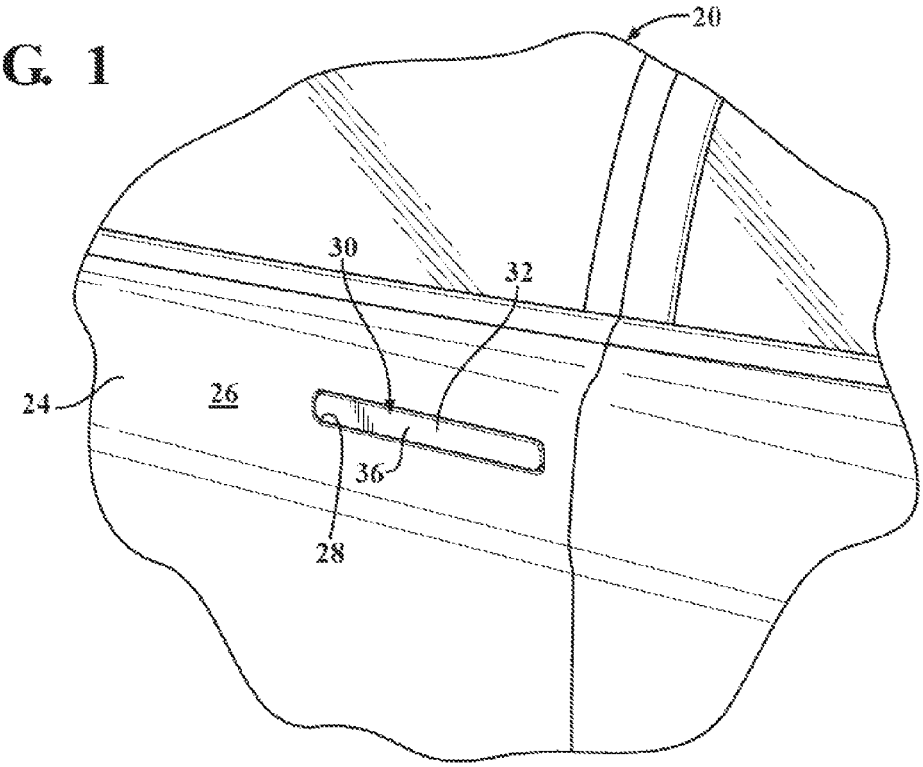
FIG. 1 is a schematic perspective view of a closure assembly showing a grab bar of a handle assembly in a retracted position.
Figure 2:
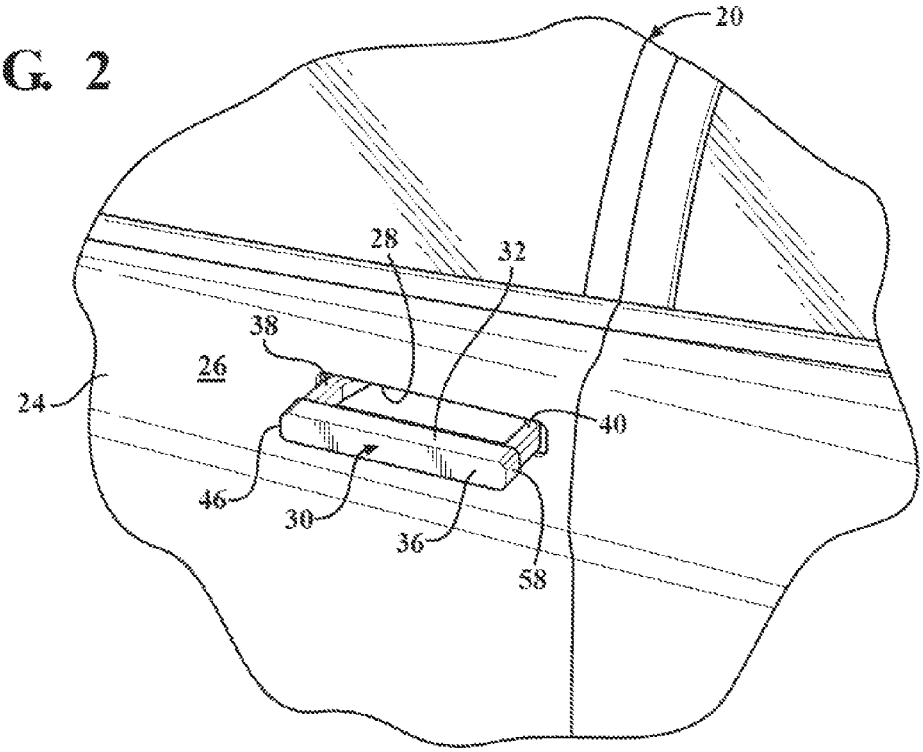
FIG. 2 is a schematic perspective view of the closure assembly showing the grab bar in an extended position.

Referring also to FIGS. 1 and 2, the exterior panel surface 26 defines an opening 28 extending therethrough. The closure assembly 20 further includes a handle assembly 30. The handle assembly 30 is coupled to the structure 22, and includes a grab bar 32 and an actuating system 34 (shown in FIGS. 3 and 4). The grab bar 32 is moveable to the exterior panel surface 26 of the structure 22 between a retracted position, shown in FIG. 1, and an extended position, shown in FIG. 2. As shown, the grab bar 32 moves in a normal direction relative to the exterior panel surface 26. However, the grab bar 32 may alternatively be configured to move in a non-normal direction relative to the exterior panel surface 25. As used herein, the term "normal direction" refers to movement in a direction that is substantially perpendicular to a surface without pivotal and/or rotational movement relative to the surface. It should be appreciated that the exterior panel surface 26 of the closure assembly 20 may include a three dimensional shape that is not perfectly planar. Accordingly, it should be appreciated that the grab bar 32 may move in a direction that is not exactly perpendicular, i.e., not exactly ninety degrees relative to the exterior panel surface 26. However, the grab bar 32 moves relative to the exterior panel surface 26 without rotating and/or pivoting relative to the exterior panel surface 26. Furthermore, it should be appreciated that the movement of the grab bar 32 is normal to the exterior panel surface 26, regardless of the orientation of the exterior panel surface 26 relative to a ground surface. Accordingly, the movement of the grab bar 32 relative to the exterior panel surface 26 may be in a vertical direction relative to the ground, in a horizontal direction relative to the ground, or at any angle therebetween.

The grab bar 32 includes an outboard surface 36, and is positioned within the opening 28 when in the retracted position, with the outboard surface 36 of the grab bar 32 approximately flush with the exterior panel surface 26 of the structure 22. As used herein, the term "approximately flush" is defined to include surfaces that are substantially disposed on the same plane, but that may include minor feature differences, such as a surface curvature or design accent, that slightly deviate from the shared plane. The grab bar 32 is laterally spaced outboard of the exterior panel surface 26 of the structure 22 when the grab bar 32 is in the extended position, thereby allowing an operator to grasp the grab bar 32. The grab bar 32 and the opening 28 are sized and shaped to match each other so that the grab bar 32 fits neatly within the opening 28 when in the retracted position, presenting a continuous exterior surface of the closure assembly 20. The grab bar 32 and the opening 28 may each include a complimentary shape and/or configuration deemed appropriate to meet the design and styling requirements of the closure assembly 20.

Referring to FIGS. 3 and 4, the actuating system 34 is coupled to the grab bar 32. The actuating system 34 is configured for moving the grab bar 32 between the retracted position, shown in FIG. 3 and the extended position, shown in FIG. 4. The actuating system 34 may include any suitable system capable of moving the grab bar 32. For example, the actuating system 34 may include but is not limited to an electro-mechanical actuating system 34, which is shown and described herein as an exemplary embodiment. However, it should be appreciated that the actuating system 34 may differ from the exemplary embodiment shown and described herein.

The actuating system 34 includes a first control arm 38 and a second control arm 40. The first control arm 38 includes a first end 42 and a second end 44. The first end 42 of the first control arm 38 is rotatably coupled to a first longitudinal end 46 of the grab bar 32. The second end 44 of the first control arm 38 is coupled to the structure 22 for translation or lateral movement in a direction parallel to a longitudinal axis 48 of the grab bar 32. For example, the second end 44 of the first control arm 38 may be coupled to the structure 22 via a first pin 50 that is slideably moveable within a slot 52 defined by the structure 22, with the slot 52 extending substantially parallel with the longitudinal axis 48 of the grab bar 32. While the slot 52 is shown in FIGS. 3 and 4 defining a straight linear path, it should be appreciated that the slot 52 may alternatively be curved to define a curvilinear path.

Similarly, the second control arm 40 includes a first end 54 and a second end 56. The first end 54 of the second control arm 40 is rotatably coupled to a second longitudinal end 58 of the grab bar 32. The second end 56 of the second control arm 40 is coupled to the structure 22 for translation or lateral movement in a direction parallel to the longitudinal axis 48 of the grab bar 32. For example, the second end 56 of the second control arm 40 may be coupled to the structure 22 via a second pin 60 that is slideably moveable within the slot 52 defined by the structure 22. As noted above, the slot 52 extends substantially parallel with the longitudinal axis 48 of the grab bar 32.

The actuating system 34 further includes a first swing arm 62 and a second swing arm 64. The first swing arm 62 includes a first end 66 and a second end 68. The first end 66 of the first swing arm 62 is rotatably coupled to the first control arm 38. The second end 68 of the first swing arm 62 is positionally fixed relative to the structure 22. The second swing arm 64 includes a first end 70 and a second end 72. The first end 70 of the second swing arm 64 is rotatably coupled to the second control arm 40. The second end 72 of the second swing arm 64 is positionally fixed relative to the structure 22.

The actuating system 34 further includes a drive assembly 74. The drive assembly 74 is coupled to and interconnects the first swing and the second swing arm 64. The drive assembly 74 is configured for rotating the first swing arm 62 about a first swing axis 76, and the second swing arm 64 about a second swing axis 78. Rotation of the first swing arm 62 about the first swing axis 76 moves the first control arm 38. The second end 44 of the first control arm 38 is free to translate within the slot 52, yet prevents movement of the second end 44 of the first control arm 38 in a normal direction relative to the exterior panel surface 26 of the closure assembly 20. Accordingly, rotational movement of the first swing arm 62 about the first swing axis 76 causes the second end 44 of the first control arm 38 to move along the slot 52 in a direction parallel with the longitudinal axis 48 of the grab bar 32, and approximately parallel with the exterior panel surface 26 of the closure assembly 20, indicated at 80. The movement of the second end 44 of the first control arm 38 along the slot 52 in response to rotation of the first swing arm 62 about the first swing axis 76 causes the first end 42 of the first control arm 38 to rotate about a first control axis 82. In doing so, the first swing arm 62 and the first control arm 38 act in a scissor like motion to move the grab bar 32 in a normal direction toward and away from the exterior panel surface 26, depending upon which direction the first swing arm 62 is rotated about the first swing axis 76.

Similarly, rotation of the second swing arm 64 about the second swing axis 78 moves the second control arm 40. The second end 56 of the second control arm 40 is free to translate within the slot 52, yet prevents movement of the second end 56 of the second control arm 40 in a normal direction relative to the exterior panel surface 26 of the closure assembly 20. Accordingly, rotational movement of the second swing arm 64 about the second swing axis 78 causes the second end 56 of the second control arm 40 to move along the slot 52 in a direction parallel with the longitudinal axis 48 of the grab bar 32, and approximately parallel with the exterior panel surface 26 of the closure assembly 20, indicated at 80. The movement of the second end 56 of the second control arm 40 along the slot 52 in response to rotation of the second swing arm 64 about the second swing axis 78 causes the first end 54 of the second control arm 40 to rotate about a second control axis 84. In doing so, the second swing arm 64 and the second control arm 40 act in a scissor like motion to move the grab bar 32 in a normal direction toward and away from the exterior panel surface 26, depending upon which direction the second swing arm 64 is rotated about the second swing axis 78. It should be appreciated that the first swing arm 62 and the first control arm 38 act simultaneously and in unison with the second swing arm 64 and the second control arm 40 to move the grab bar 32 between the extended position and the retracted position in the normal direction relative to the exterior panel surface 26 of the closure assembly 20.

The drive assembly 74 may include any device capable of simultaneously rotating the first swing arm 62 about the first swing axis 76 and the second swing arm 64 about the second swing axis 78 in unison. For example, by way of an exemplary embodiment shown and described herein, the drive assembly 74 may include a first drive gear 86 and a second drive gear 88, each positionally fixed to the structure 22 for rotation about a rotation axis 90. The rotation axis 90 is generally perpendicular to both the first swing axis 76 and the second swing axis 78. An actuator 92 is coupled to each of the first drive gear 86 and the second drive gear 88. The actuator 92 is configured for rotating each of the first drive gear 86 and the second drive gear 88 about the rotation axis 90. The actuator 92 may include, but is not limited to an electric motor or other similar device. A first driven gear 94 is positionally fixed to the structure 22 for rotation about the first swing axis 76. The first driven gear 94 is attached to the second end 68 of the first swing arm 62, and is in meshing engagement with the first drive gear 86. The first drive gear 86 meshes with the first driven gear 94 to rotate the first driven gear 94 about the first swing axis 76, thereby rotating the first swing arm 62 about the first swing axis 76. A second driven gear 96 is positionally fixed to the structure 22 for rotation about the second swing axis 78. The second driven gear 96 is attached to the second end 72 of the second swing arm 64, and is in meshing engagement with the second drive gear 88. The second drive gear 88 meshes with the second driven gear 96 to rotate the second driven gear 96 about the second wing axis 78. As shown, each of the first drive gear 86, the first driven gear 94, the second drive gear 88 and the second driven gear 96 each include a bevel gear. It should be appreciated that the drive assembly 74 shown and described herein is merely an exemplary embodiment, and that the drive assembly 74 may differ from that shown and described herein.

The closure assembly 20 may further include a latch mechanism 98. The latch mechanism 98 is coupled to the structure 22 of the closure assembly 20, and is moveable between a latched position for securing the closure assembly 20 in place relative to the vehicle, and an un-latched position for allowing movement of the closure assembly 20 relative to the vehicle. The latch mechanism 98 may include any suitable style and/or design capable of latching and un-latching the closure assembly 20. For example, the latch mechanism 98 may include a latch (not shown) configured to engage a striker (not shown) when in the latched position, and is disengages from the striker when in the un-latched position.

The closure assembly 20 may further include a control module 100. The control module 100 is in communication with the handle assembly 30 and the latch mechanism 98 and may be configured for controlling one or both of the handle assembly 30 and the latch mechanism 98. The control module 100 may include, for example, a computer or other similar device having all necessary software, hardware, algorithms, processor(s), communication links, etc., required to receive and send data and/or control signals to one or both of the handle assembly 30 or the latch mechanism 98. The control module 100 may be linked for communication with the handle assembly 30 and/or the latch mechanism 98 through a hardwired connection or through a wireless system.

The latch mechanism 98 may be configured for receiving a signal from the handle assembly 30. The latch mechanism 98 may receive the signal directly from the handle assembly 30, or may receive the signal indirectly through the control module 100. The signal from the handle assembly 30 controls movement of the latch mechanism 98 between the latched position and the un-latched position. The handle assembly 30 may include a usage sensor 102 configured for sensing when the grab bar 32 is in the grasp of the operator. The usage sensor 102 may include any suitable device capable of sensing when the grab bar 32 is in the grasp of the operator, including but not limited to a pressure sensor or other similar device. The handle assembly 30 signals the latch mechanism 98 to move between the latched position and the un-latched position when the usage sensor 102 senses that the grab bar 32 is in the grasp of an operator. More specifically, the handle assembly 30 signals the latch mechanism 98 to move into the un-latched position when the usage sensor 102 senses that the grab bar 32 is in the grasp of the operator, thereby allowing the operator to unlatch the latch mechanism 98 to open the closure assembly 20.

The closure assembly 20 may further include a position sensor 104. The position sensor 104 is coupled to the control module 100, and is configured for sensing a presence of the operator within a pre-determined distance of the closure assembly 20. The position sensor 104 may send data to the control module 100 indicating that the operator has been detected. The position sensor 104 may include any device capable of sensing the presence of the operator, and may include but is not limited to a receiver configured for receiving a signal from a handheld device carried by the operator, or a dedicated touch sensor manually operated by the operator. Upon the position sensor 104 sensing the presence of the operator and sending data related thereto to the control module 100, the control module 100 signals the handle assembly 30 to move the grab bar 32 from the refracted position into the extended position, thereby preparing the handle assembly 30 to allow the operator to grasp the grab bar 32 to open the closure assembly 20. When the position sensor 104 fails to sense the presence of the operator, the control module 100 signals the handle assembly 30 to move the grab bar 32 from the extended position into the retracted position, or to maintain the position of the grab bar 32 in the retracted position so that the outboard surface 36 of the grab bar 32 remains flush with the exterior panel surface 26 of the closure assembly 20.

The control module 100 may be in communication with a remotely located device, such as but not limited to a satellite communication system. The control module 100 may be configured for receiving a signal from the remotely located device requesting that the control module 100 signal the handle assembly 30 to move the grab bar 32 between the extended position and the retracted position. For example, in the event the operator is unable to open the door, the operator may request that the remotely located device signal the control module 100 of the closure assembly 20 to move the grab bar 32 into the extended position to allow the operator to open the closure assembly 20. Furthermore, the control module 100 may be configured to automatically signal the handle assembly 30 to move the grab bar 32 from the retracted position in to the extended position upon the occurrence of a pre-determined event. The pre-determined event may include but is not limited to a vehicular accident. For example, if the control module 100 determines or is otherwise notified through another vehicular system that the vehicle has been involved in an accident, the control module 100 automatically signals the handle assembly 30 to move the grab bar 32 into the extended position so that emergency personnel may grasp the grab bar 32 to open the closure assembly 20.

A method of controlling the handle assembly 30 is also provided. The method includes sensing the presence of an operator within a pre-defined distance of the handle assembly 30. When the presence of the operator is sensed, the handle assembly 30 is signaled to position the grab bar 32 in the extended position. When the grab bar 32 is positioned in the retracted position and the handle assembly 30 is signaled to position the grab bar 32 in the extended position, the grab bar 32 is moved in a normal direction relative to an exterior panel surface 26 of the vehicle door from the retracted position into the extended position, thereby allowing the operator to grasp the grab bar 32 to open the vehicle door.

When the presence of the operator is not sensed, the handle assembly 30 is signaled to position the grab bar 32 of the handle assembly 30 in the retracted position. When the grab bar 32 is positioned in the extended position and the handle assembly 30 is signaled to position the grab bar 32 in the retracted position, the grab bar 32 is moved in a normal direction relative to the exterior panel surface 26 of the vehicle door from the extended position into the retracted position so that an outboard surface 36 of the grab bar 32 is disposed flush with the exterior surface panel 24 when the grab bar 32 is not needed to open the vehicle door.

The method further includes sensing when the grab bar 32 is in the grasp of the operator. When the grab bar 32 is sensed to be in the grasp of the operator, the latch assembly is signaled to move from the latched position into the unlatched position to allow the operator to open the closure assembly 20. When the grasp of the operator on the grab bar 32 is not sensed, the latch mechanism 98 is signaled to allow the latch mechanism 98 to return to back into the latched position when the closure assembly 20 is properly positioned.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A door closure assembly for a vehicle, the door assembly comprising:

a structure including an exterior panel surface defining an opening extending therethrough;

a handle assembly coupled to the structure and including a grab bar having an outboard surface and moveable relative to the exterior panel surface of the structure between a retracted position and an extended position;

wherein the grab bar is positioned within the opening when in the retracted position with the outboard surface of the grab bar approximately flush with the exterior panel surface of the structure, and wherein the grab bar is laterally spaced outboard of the exterior panel surface of the structure when the grab bar is in the extended position;

a first control arm rotatably coupled to a first longitudinal end of the grab bar;

a first swing arm rotatably coupled to the first control arm and the structure;

a second control arm rotatably coupled to a second longitudinal end of the grab bar;

a second swing arm rotatably coupled to the second control arm and the structure;

a drive assembly coupled to and interconnecting the first swing and the second swing arm and configured for rotating the first swing arm and the second swing arm, which in turn rotate the first control arm and the second control arm respectively to move the grab bar in the normal direction relative to the exterior panel surface between the extended position and the retracted position, wherein the drive assembly includes:

a first drive gear positionally fixed to the structure for rotation about a rotation axis;

a first driven gear positionally fixed to the structure for rotation about a first swing axis perpendicular to the rotation axis, wherein the first driven gear is attached to the second end of the first swing arm and in meshing engagement with the first drive gear;

a second drive gear positionally fixed to the structure for rotation about the rotation axis; and a second driven gear positionally fixed to the structure for rotation about a second swing axis perpendicular to the rotation axis, wherein the second driven gear is attached to the second end of the second swing arm and in meshing engagement with the second drive gear.

2. A door assembly as set forth in claim 1 wherein each of the first drive gear, the first driven gear, the second drive gear and the second driven gear include a bevel gear.

3. A door assembly as set forth in claim 1 wherein the drive assembly includes an actuator coupled to each of the first drive gear and the second drive gear and configured for rotating each of the first drive gear and the second drive gear.

4. A door assembly as set forth in claim 2 wherein the actuator includes an electric motor.

5. A door assembly as set forth in claim 1 further comprising a latch mechanism coupled to the structure and moveable between a latched position and an un-latched position.

6. A door assembly as set forth in claim 5 wherein the latch mechanism is configured for receiving a signal from the handle assembly for controlling movement of the latch mechanism between the latched position and the un-latched position.

7. A door assembly as set forth in claim 6 wherein the handle assembly includes a usage sensor configured for sensing when the grab bar is in the grasp of an operator.

8. A door assembly as set forth in claim 7 wherein the handle assembly is configured for signaling the latch mechanism to move between the latched position and the un-latched position when the usage sensor senses that the grab bar is in the grasp of an operator.

9. A door assembly as set forth in claim 5 further comprising a control module in communication with the handle assembly and the latch mechanism and configured for controlling the handle assembly and the latch mechanism.

10. A door assembly as set forth in claim 9 further comprising a position sensor coupled to the control module and configured for sensing a presence of an operator.

11. A door assembly as set forth in claim 10 wherein the control module is configured to signal the handle assembly to move the grab bar between the extended position and the retracted position.

12. A door assembly as set forth in claim 11 wherein the control module is in communication with a remotely located device and configured for receiving a signal from the remotely located device to move the grab bar between the extended position and the retracted position.

13. A door assembly as set forth in claim 11 wherein the control module is configured to automatically signal the handle assembly to move the grab bar from the retracted position in to the extended position upon the occurrence of a pre-determined event.

* * * * *